United States Patent [19]

Vinicombe

[11] Patent Number: 4,770,089

[45] Date of Patent: Sep. 13, 1988

[54] TEMPORARY GRATE COVER FOR PAINT SPRAY BOOTH AREAS

[76] Inventor: Gerald K. Vinicombe, 6205 Valley Forge, Kalamazoo, Mich. 49009

[21] Appl. No.: 56,580

[22] Filed: May 29, 1987

[51] Int. Cl.[4] ..... B05B 15/12

[52] U.S. Cl. ..... 98/115.2; 118/326

[58] Field of Search ..... 98/115.2; 118/326, 634, 118/DIG. 7; 126/25 R

[56] References Cited

U.S. PATENT DOCUMENTS

| | | | |
|---|---|---|---|
| 3,082,757 | 3/1963 | Hohe | 126/25 R |
| 3,589,265 | 6/1971 | Hedrick | 98/114 |
| 3,717,083 | 2/1973 | Karapetian | 126/25 R X |
| 4,285,270 | 8/1981 | Donahue | 98/115.2 |

*Primary Examiner*—Harold Joyce

*Attorney, Agent, or Firm*—Flynn, Thiel Boutell & Tanis

[57] ABSTRACT

A cover for paint spray area grates, the grate cover being arranged for shielding the grate blades and grate cross members from paint particles entrained in air drawn down through the grate and for facilitating installation of the cover on the grate without substantially inhibiting air flow down through the grate. The cover comprises a lightweight plastic one piece member having (1) a top wall comprising perimeter portions integral with plural length and width cross portions bounding a plurality of openings substantially coextensive with corresponding openings in the grate to be covered, and (2) skirts depending into the openings from the perimeter portions, length cross portions and width cross portions. Parts of the skirts adjacent said top wall are positioned close to the top of the grate blades and grate cross members. A pair of the skirts flank each grate blade and cross member. Each pair of flanking skirts is downwardly divergent so the space between the bottom edges of such pair of skirts is wider than the space between the top edges of the skirts. The skirts bounding each opening define a steep funnel shape such that the opening has a somewhat larger area at the top than at the bottom thereof. The skirts in each opening are connected at the corners thereof such that the skirts form a continuous perimeter wall for such opening.

13 Claims, 4 Drawing Sheets

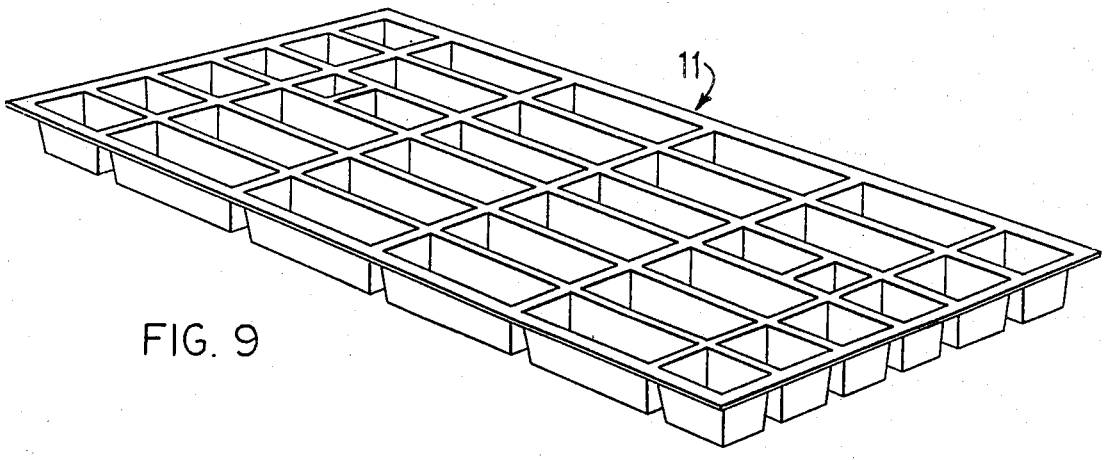
FIG. 9
FIG. 3
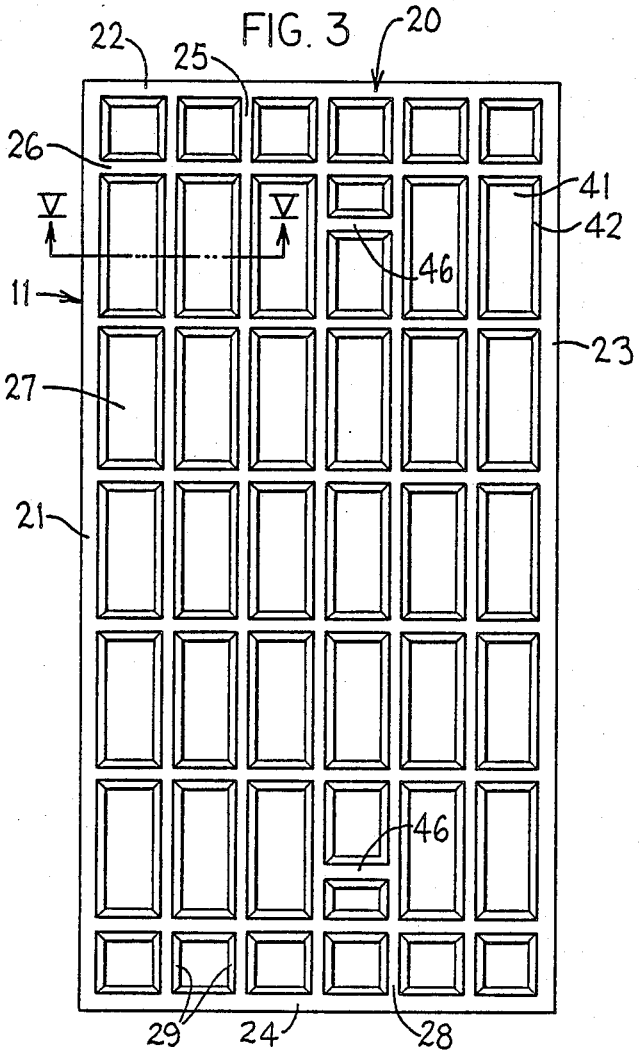
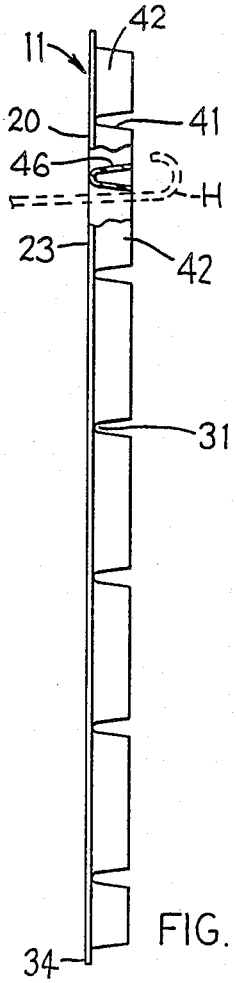
FIG. 4
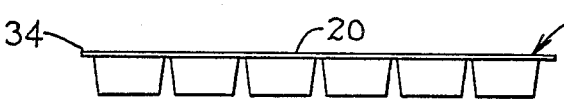
FIG. 6

TEMPORARY GRATE COVER FOR PAINT SPRAY BOOTH AREAS

INTRODUCTION

This invention relates to improvements in covers for temporary use in protecting grates in paint spray areas of the kind in which air is directed down through the grates in the floor area thereof to direct, remove and collect excess spray paint therefrom.

BACKGROUND OF THE INVENTION

Hedrick U.S. Pat. No. 3,589,265 discloses a floor heat duct register or grate and an aluminum cover therefor which cover is intended to be a permanently attached, e.g., welded, decorative covering of the underlying floor register grate or blades thereof. However, such a grate cover would not be a practical grate cover design for use in paint spray booths or other areas. The problem in such production plant paint spray booths or areas are quite different from decorative dressing for floor registers of a heat duct in a house or office being heated, as will be apparent from the following discussion.

In typical plant production paint spray areas endless conveyor lines and chain or linkage assemblies pull dollies carry pieces such as auto body shells or pieces to be painted. Such paint spray areas include air down draft booths designed to force clean air down over the paint spray tools and pieces being painted to direct, remove and collect excess paint overspray, which does not land on the pieces being painted, as an air/atomized paint spray mixture down through a grated floor. Under the grated floor, moving water streams typically collect the air/paint mixture for conveying through water channels to an air/water/paint separation area, away from the paint spray booth. Separation may be by addition of a flocculating agent, which surrounds the paint particles, which particles are then decanted or filtered from the water. The water can then be recirculated, often after dilution with a percentage of fresh water, to the paint spray booth for reuse.

In the paint spray booth itself, as production painting proceeds hour after hour, shift after shift, the floor grates therein accumulate large undesired buildups of paint spray that falls thereon, which excess paint must be periodically removed, to maintain the efficiency of the excess paint spray removal process, and the paint spray booth operation itself.

To date, the paint removal process from floor grates in these paint spray booths has involved a variety of labor intensive and often pollution causing problems. For example, high pressure water agitator machines have been used to clean such paint spray booth grates, but such procedures normally only clean the top surfaces of the grates. Even if such machines are effective to remove essentially all of the paint from the top and sides of the grate blades, same cause removed paint in the form of paint globs to fall down into the water, and be carried away as such. Alternatively, some plant paint spray booth cleaners have tried using paint solvents or thinners to dissolve and remove the excess paint down into the waste water system. However, in such case the waste water then is loaded with the organic liquid paint solvent or thinner which must also be removed. This complicates further the problem of separating components of the flowing mixture.

Another problem associated with removal of excess paint spray from plant production paint spray booths is the fact that some manufacturers use high solids enamel paint compositions that retain their "live", sticky paint characteristics as the excess paint is carried down in the air/water disposal system. These high-solids enamel paints continue to be sticky on the grate-block surfaces, and are not "deadened" by additives to paint spray booth disposal water systems. Such enamel paints accumulate even more rapidly on the grate floors than some of the older acrylic lacquer paints which dry faster. Even more frequent cleaning is thus required.

Those in the industrial paint spray art continue to look for more efficient methods and apparatus to make more environmentally acceptable and economical the re-conditioning of paint spray booth surfaces.

OBJECTS OF THE INVENTION

It is an object of this invention to provide an improved, temporary, disposable paint spray area grate cover.

It is a further object of this invention to provide temporary paint spray booth grate covers that collect more paint spray than known grate covers, and which covers are easily removed from their in-place contact with the underlying grates.

SUMMARY OF THE INVENTION

The objects and purposes of the invention are met by providing a cover for paint spray area grates, including grates of the kind having perimeter blades bounding the perimeter of the grate, plural grate blades running in spaced parallel direction along one dimension of the grate and plural grate cross members extending transverse to the grate blades. The cover includes means for shielding the grate blades and grate cross members from paint particles entrained in air drawn down through the grate and for facilitating installation of the cover on the grate without substantially inhibiting air flow down through the grate. Such means comprise a lightweight plastic one piece member. Such member has a top wall comprising perimeter portions integral with plural length and width cross portions bounding a plurality of openings substantially coextensive with corresponding openings in the grate to be covered. Such member further has skirts depending into said openings from said perimeter portions, length cross portions and width cross portions. Parts of said skirts adjacent said top wall are positioned close to the top of the grate blades and grate cross members. A pair of said skirts flank each grate blade and cross member. Each said pair of flanking skirts is downwardly divergent so the space between the bottom edges of such pair of skirts is wider than the space between the top edges of said skirts. The skirts bounding each opening define a steep funnel shape such that said opening has a somewhat larger area at the top than at the bottom thereof. The skirts in each opening are connected at the corners thereof such that said skirts form a continuous perimeter wall for such opening.

BRIEF DESCRIPTION OF THE DRAWINGS

FIG. 3 is an enlarged top plan detail view of a single grate cover according to FIG. 2;

FIG. 4 is a right side elevational view of the grate cover of FIG. 3;

FIG. 6 is an end elevational view of the grate cover of FIG. 3;

FIG. 9 is a pictorial view of the grate cover of FIG. 3;

Figure 1:
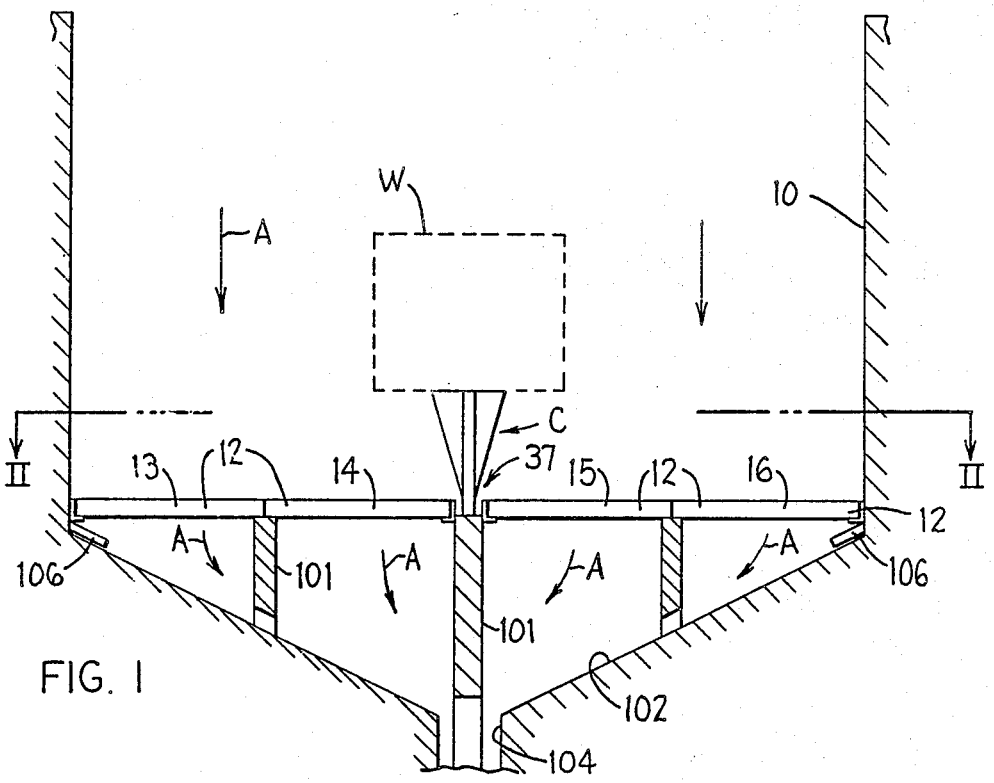
FIG. 1 is a schematic elevational view, taken in cross section, of a typical industrial paint spray booth showing, e.g., four sections of grate flooring to be covered according to this invention.

Certain terminology will be used in the following description for convenience in reference only, and will not be limiting. For example, the words "horizontal", "vertical", "up", "down", "right", "left", and the like, will refer to directions in the drawings. Said terminology will include words of similar import and derivatives thereof.

DETAILED DESCRIPTION

Figure 2:
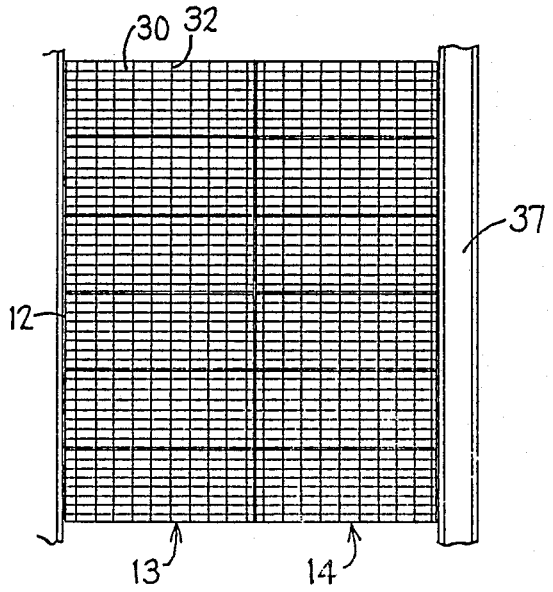
FIG. 2 is a top plan view substantially taken on the line II—II of FIG. 1, showing the layout of grate covers, embodying the invention.

Referring to FIGS. 1 and 2, a typical paint spray booth 10 has grates 12 which define the floor of the spray booth. Conventional grates 12 typically are of steel and comprise parallel spaced longitudinal blades 30 (FIGS. 5 and 8) of flat bar stock, arranged with width vertical and thickness horizontal. To the blades 30 are welded spaced, parallel cross members 32 of round rod stock flush with the tops of the blades 30, blades 30 and members 32 form a uniform openwork grid, whose perimeter is defined by four perimeter blades 36. A typical spray booth floor has four rows 13, 14, 15 and 16 of grates 12, which rows extend the length of the grate area of the paint spray booth. Typically the grates are approximately two feet wide by five feet long by about 2 to 3 inches high. The length of the paint spray booth in a typical plant might require as many as 400 grates.

A top view of part of the grate area of the paint spray booth floor is shown in FIG. 2. FIG. 2 shows two rows 13 and 14 of grates 12 adjacent to a center conveyor line path 37, along which workpieces W to be painted are conveyed, by conventional conveyor means schematically shown at C. Typically, the rows 13–16 of grates 12 are supported by suitable supports 101 over a funnel-like trough 102 which empties into a longitudinally extending drain channel 104 leading to a station (not shown) for separation of air, water and paint overspray material. Water inlets 106 distributed along the length of the trough 102 supply a film of water over the sloped bottom walls of the trough 102 to carry paint overspray material downwardly into the drain channel 104. Conventional air circulating means, not shown, introduces air in the upper portion of the spray booth 10 and withdraws air along the drain channel 104. This provides a constant flow A of air downward past the workpieces W and paint spray sources (e.g. guns), not shown, and positively carries paint overspray (paint particles not attaching to the work pieces W) downwardly through the grates 12 and into contact with the film of water sheeting down over the sloped bottom walls of the trough 102. The foregoing paint spray booth construction is conventional and is described merely as one example of a typical environment for the grate covers embodying the invention and hereafter described.

A grate cover 11 embodying the invention is seen in FIGS. 3 to 6. The cover 11 has a top wall 20 comprising perimeter portions 21, 22, 23 and 24, integral with plural length and width cross portions 25 and 26, bounding a plurality of grate cover openings 27 essentially coextensive with corresponding openings in the underlying grate 12. The grate cover 11 is dimensioned so that its marginal portions 21–24, length cross portions 25 and width cross portions 26 respectively and substantially coextensively cover the top surfaces of the perimeter blades 36, longitudinal grate blades 30 and grate cross members 32 of a grate 12.

Integrally dependent from the cover top wall 20 into the openings 27 are widthwise and lengthwise skirts 41 and 42. More particularly, the widthwise and lengthwise skirts 41 and 42 depend respectively from the length and width cross portions 25 and 26 of the cover top wall 20. The skirts 41 and 42 preferably are slightly angled away from the vertical, in a direction away from the respective grate blades 30 and cross members 32 which they are to protect, for example at about a 5° to 10° (preferably about 7°) angle to the vertical, and so that each opening 27 in the cover is steeply funnel shaped.

The slope of the skirts 41 and 42 provides several advantages. Because their steep slope, the openings 27 in the cover are almost as large as the corresponding openings in the grate 12, so as not to significantly restrict in the flow of air A downward through the grate cover 20 covering a grate 12 in the paint spray booth 10. Further, since the skirt 41, or 42 on opposite sides of a given grate cross member 32 or blades 30, diverge downwardly (flare) slightly away therefrom and from each other, it is easier and quicker to drop the cover 20 onto a grate 12 and, after use, lift a cover 20 off its corresponding grate 12. Further, since the flanking skirts 42 flare slightly away from the grate blades 30, near the bottoms of the latter, and since paint overspray particles are entrained in a stream of air positively downwardly passing through the covered grates 12, the lower edges of at least some of the interior positioned skirts 42, for example, can be located somewhat above the bottom edges of the blades 30, such that the depth of the cover 20 can be somewhat less than the depth of the grate 12, without risk of contaminating the lower portions of the blades 30 with paint particles. Further, the sloping of the skirts 41 and 42 facilitates molding of the cover 11 in one piece, by facilitating removal of the cover 11 from a one piece male mold member (not shown). The sloping of the skirts also permits shipping and storing of covers 12 in a nested condition, reducing space needed and cost.

While the skirts 41 and 42 can be made to extend the full depth of the grate blades 30, such is normally not necessary for the reasons abovementioned, namely because of their downward flair and the entrainment of paint particles in downward moving air. Typically, the skirts 41 and 42 extend downward to about two-thirds the depth of the grate blades 30.

Figure 7:
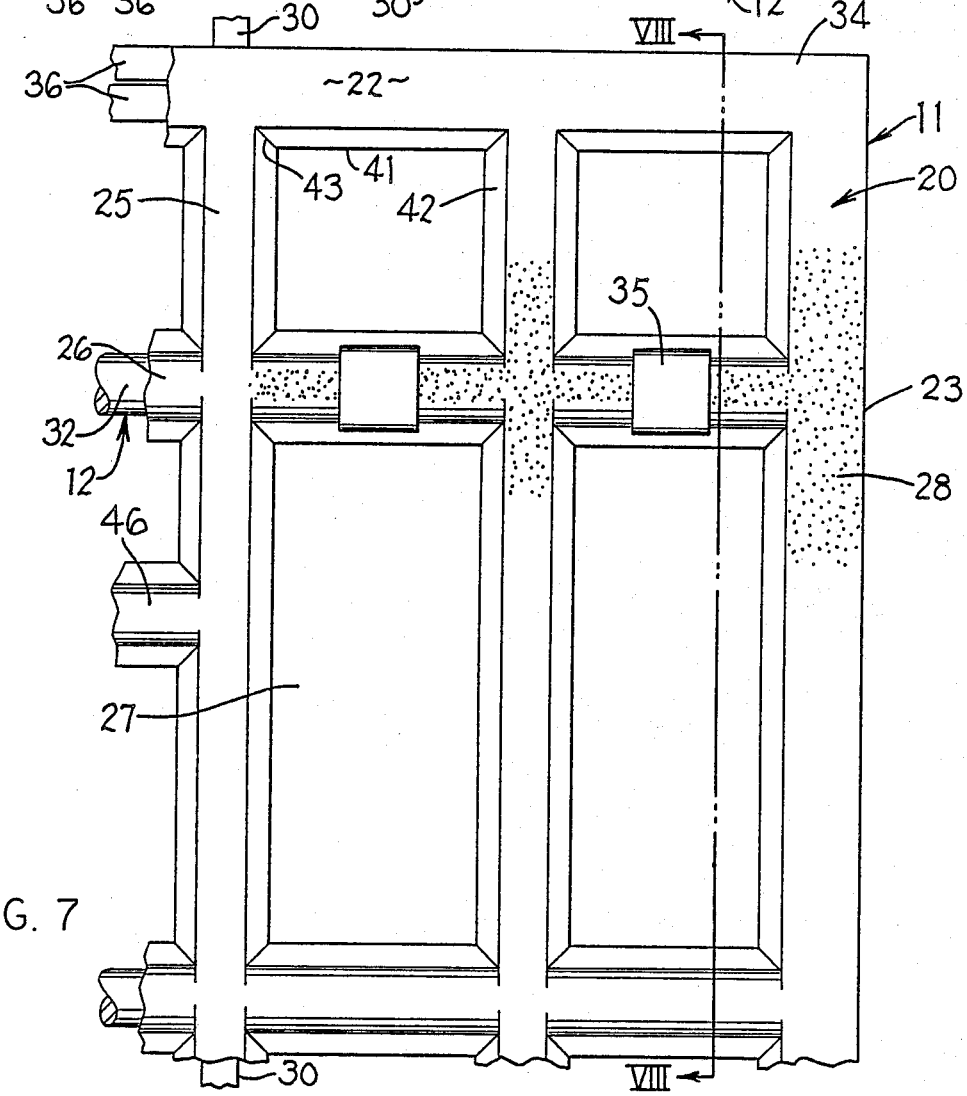
FIG. 7 is an enlarged fragment of FIG. 3, showing the positioning of optional U-shaped clip fasteners, for retaining the grate cover on the underlying grate.

The widthwise skirts 41 and lengthwise skirts 42, defining each opening 27, preferably are of the same depth and join at the four corners 43 of each opening, such that each opening 27 has a closed perimeter defined by the skirts 41 and 42 and corners 43 where they join. Looked at from underneath, the arrangement of skirts 41 and 42 of the cover 11 thus provides downward opening widthwise and longitudinal channels 29 and 31 (FIGS. 5 and 8) for receiving the grate blades 30 and cross members 32, respectively. The tops of the channels 29 and 31 preferably are sufficiently narrow as to snugly engage the tops of the grate blades 30 and cross members 32 so that the grate cover 11 does not tend to shift or slide horizontally on the grate 12, for example when walked on by paint spray booth personnel. FIG. 7 also shows part of an optionally roughened (skid-resistant) surface texture 28 on the top of the grate cover.

Figure 5:
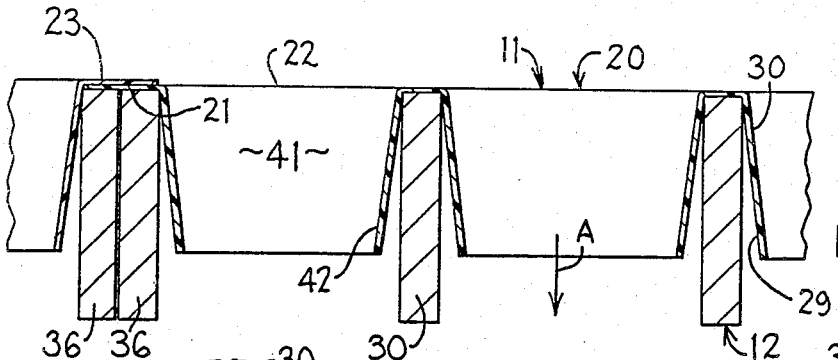
FIG. 5 is an enlarged cross sectional view substantially taken on the line V—V of FIG. 3.

The cover perimeter portions 21–24 normally will be substantially the same width as the grate perimeter blades 36, so that the outer faces of the grate perimeter blades 36 will be flush with the outer edges of the cover perimeter portions 21–24. However, as shown in FIGS. 5–7, the cover perimeter portions 21–24 can be widened enough to overlap the perimeter area of adjacent grate covers (as at 21, 23 in FIG. 5).

Figure 8:
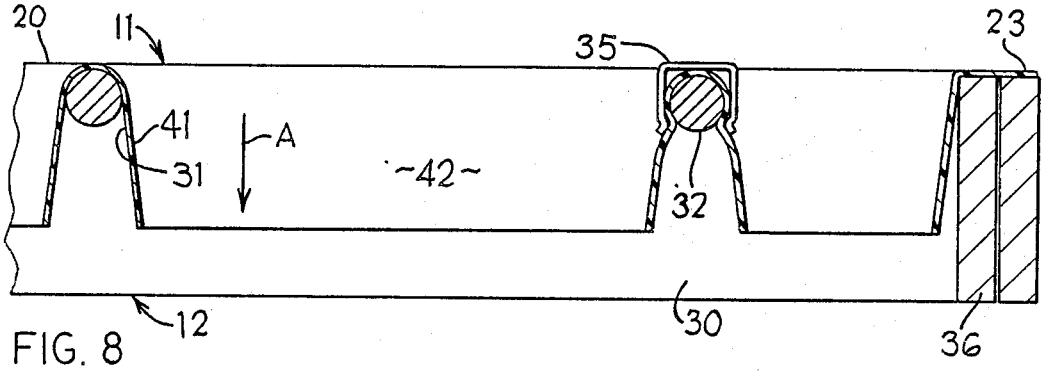
FIG. 8 is a fragmentary sectional view taken on the line VIII—VIII of FIG. 7.

Although the cover 11 will by friction and gravity tend to hold itself in place on the grate 12, optionally the cover 11 can be held in place on the underlying grate 12 by other means, such as springy, U-shaped, undercut retaining clips 35 which, as shown in FIGS. 7 and 8, tend to pinch the material of the skirts (e.g. skirt 31) against the grate 12 (e.g. member 32).

Grate cover 11 embodying the invention are to be made with various grid layouts and dimensions, to fit different underlying grate designs so that the grate covers will easily fit and effectively cover the existing grates in place in any particular paint spray area or booth.

The inventive paint spray booth grate covers 11 can be made from any readily available, economical, plastic composition which can be blow molded, or vacuum molded, into the desired shape, or extruded into a mold which will form the inventive grate cover. Examples of acceptable plastic compositions, which can be softened or melted and then formed into the inventive grate covers, are low-pressure polyethylene compositions which form relatively tough, impact resistant surfaces that can be easily cut and bent or molded, when hot, to form the required grate cover top, openings and skirts having the desired flared configuration. Other plastic compositions or formulations polyethylene glycol terephthalate polyester sheets, such as clear plastic sheets, approximately 0.040 inch thick, sold by Sheffield Plastics under the trade name "VIVAK" polyester. It is preferred to use a plastic composition which, when formed into the desired grate cover is (a) essentially static resistant, (that is, conductive to static electric charges) and (b) otherwise environmentally and safety acceptable for paint spray booth use applications.

To facilitate removal from their respective grates of these temporary grate covers 11, as when they are extensively covered with excess paint, the grate cover 11 can include removal bars 46 (FIG. 3), incorporated by molding therein. The removal bars 46 preferably extend widthwise of the cover openings 27. Each removal bar 46 is spaced between the ends of its respective cover opening 27. Preferably, a pair of removal bars 46 are disposed near the opposite ends of each cover 11, in the manner indicated in FIG. 3. The removal bars 46 are conveniently substantially the same form as the width cross portions 26 of the cover 11, the removal bar 46 preferably having the same skirt depth as the skirts 41 and 42 and conveniently being of cross section similar to the width cross portions 26. Paint booth personnel can readily remove a cover 11 by gripping the removal bars 46 and pulling the cover upward off the grate. To avoid stooping, paint booth personnel can utilize elongate hook shaped tools, as indicated in broken lines at H in FIG. 4, to engage and pull up on the removal bar 46.

The grate cover 11 can be made from different colored plastic compositions, e.g., red, white and blue, to assist maintenance personnel to know whether particular grate covers have recently been changed.

OPERATION

In operation, the grates 12 of a paint spray booth or area 10 are first covered with covers 11 embodying this invention. After paint spraying has accumulated enough excess paint on the covers 11 that the covers should be replaced, e.g., between 8 hour shifts of production, or after two or more such production shifts, maintenance personnel can then lift the covers 11 from the grates 12. Removing of the optional U-shaped retaining clips 35, if provided, precedes lifting of the covers 11. The removed, paint covered covers 11 can then be disposed of. Alternatively to disposal, if the covers 11 are made of more expensive re-usable plastic, the removed covers 11 can be cleaned of excess paint, preferably at a suitable location away from the paint booth, and re-used in another grate cover installation cycle.

The grate covers 11 of this invention enable paint spray booth maintenance personnel to provide, in a timely and economical manner, a freshly reconditioned paint spray booth floor for each shift or shift interval, while protecting in an improved manner the condition of the underlying grate floor and water streams of the paint spray booth.

MODIFICATION

Figure 10:
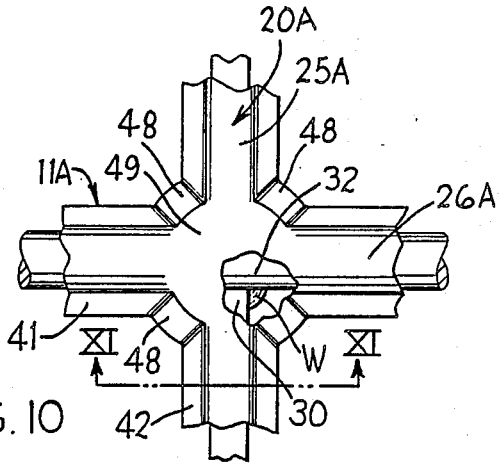
FIG. 10 is a partially broken top view, in the form of an enlarged fragment of FIG. 7, showing a modification.
Figure 11:
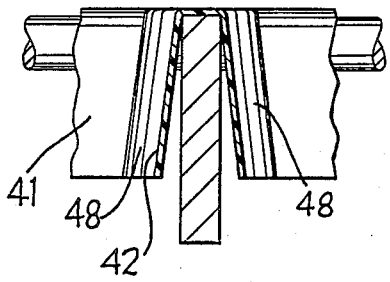
FIG. 11 is a fragmentary sectional view substantially taken on the line XI—XI of FIG. 10.

Although the joinder of the widthwise and lengthwise skirts 41 and 42 of the cover 11 may converge to form the relatively sharp corners 43 shown in the FIGS. 3—9 embodiment, without interfering with welds connecting the grate blades 30 and cross members 32, where such welds are relatively small in size or largely confined to the under portion of the grate cross members 32, it may be desired to cover grates in which the welds are laterally more bulky and weld material W bridges between the crossing grate blade 30 and cross member 32, as seen in FIG. 10, for example. In that instance, it is desirable to modify the corners 43 of the cover 11 to provide more room for laterally extending weld material W at the blade-cross member crossing points. A preferred structure for accomplishing that is shown in FIGS. 10 and 11. In FIGS. 10 and 11 the modified cover 11A has skirts 41 and 42 which do not meet directly but rather are connected by a diagonal corner plates 48 which are integral therewith. If desired, the corner plates 48 may be slightly convexly rounded as shown in FIG. 10. The top wall 20A of the cover 11A is thus correspondingly modified at the crossings of its length and width cross portions 25A and 26A by extending the top wall 20A at 49 in the corners between the length and width cross portions 25A and 26A of the top wall. The diagonal bridging structure in 48 and 49 in FIGS. 10 and 11 only slightly reduces the cross sectional area of the grate cover openings 27 but does provide clearance for relativelY bulky, laterally extending corner welds W.

In paint booth grates of which I am aware, the tops of the grates are flush and free of protruding weld material, and so the top wall 20 or 20A of the cover 11 or 11A can remain substantially flat and still be substantially continuously supported by the top of the grate 12.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A cover for paint spray area grates, including grates of the kind having perimeter blades bounding the perimeter of the grate, plural grate blades running in spaced parallel direction along one dimension of the grate and plural grate cross members extending transverse to the grate blades, comprising:

means for shielding the grate blades and grate cross members from paint particles entrained in air drawn down through the grate and for facilitating installation of the cover on the grate without substantially inhibiting air flow down through the grate, such means comprising a lightweight plastic one piece member having:

a top wall comprising perimeter portions integral with plural length and width cross portions bounding a plurality of openings substantially coextensive with corresponding openings in the grate to be covered, skirts depending into said openings from said perimeter portions, length cross portions and width cross portions, parts of said skirts adjacent said top wall being positioned close to the top of the grate blades and grate cross members, a pair of said skirts flanking each grate blade and cross member, each said pair of flanking skirts being downwardly divergent so the space between the bottom edges of such pair of skirts is wider than the space between the top edges of said skirts, the skirts bounding each opening defining a steep funnel shape such that said opening has a somewhat larger area at the top than at the bottom thereof, the skirts in each opening being connected at the corners thereof such that said skirts form a continuous perimeter wall for such opening.

2. The apparatus of claim 1 in which the portions of said skirts adjacent said top wall snugly and frictionally grip at least one of the length and width cross portions of the grate to maintain the cover on the grate against unintentional removal therefrom.

3. The apparatus of claim 1 in which said cover is of a plastic material which is (a) essentially electrically static resistant, and (b) environmentally and safety acceptable for paint spray use applications.

4. The apparatus of claim 1 in which at least one of the perimeter portions of the top wall of the cover is widened to permit its overlapping of adjacent grate perimeter blades of two adjacent grates, thereby enabling overlapping of the perimeter portions of the top wall of two adjacent covers when in place on their respective adjacent grates.

5. The apparatus of claim 1 including means for facilitating removal of the grate cover from the grate, such means comprising at least one removal bar spaced between skirts on opposite sides of a given opening, each removal bar having a portion integral with said cover top wall and depending skirt portions connecting integrally with the skirt portions on opposite sides of said opening.

6. The apparatus of claim 1 including downward opening retaining clips pressed downward over ones of the width cross portions of the cover and extending downward below the bottom of the corresponding grate cross member, to pinch the corresponding skirts against a portion of the underside of the grate cross member and thereby positively block lifting of the cover off the grate.

7. The apparatus of claim 1 in which the perimeter portions of said top wall extend at least the width of a grate perimeter blade.

8. The apparatus of claim 1 wherein the lower edges of at least some of said interior positioned skirt members are located somewhat above the bottom edges of the underlying grate blades.

9. The apparatus of claim 1 in which all of said skirts extend substantially to the same depth.

10. The apparatus of claim 9 in which the skirts at each corner of an opening meet directly to form a sharp corner.

11. The apparatus of claim 9 in which the skirts at each corner of an opening are connected by a diagonal corner plate.

12. A cover for paint spray area grates, including grates of the kind having perimeter blades bounding the perimeter of the grate, plural grate blades running in spaced parallel direction along one dimension of the grate and plural grate cross members extending transverse to the grate blades, comprising:

means for shielding the grate blades and grate cross members from paint particles entrained in air drawn down through the grate and for facilitating installation of the cover on the grate without substantially inhibiting air flow down through the grate, such means comprising a lightweight plastic one piece member having:

a top wall comprising perimeter portions integral with plural length and width cross portions bounding a plurality of openings substantially coextensive with corresponding openings in the grate to be covered, skirts depending into said openings from said perimeter portions, length cross portions and width cross portions, parts of said skirts adjacent said top wall being positioned close to the top of the grate blades and grate cross members, a pair of said skirts flanking each grate blade and cross member, each said pair of flanking skirts being downwardly divergent so the space between the bottom edges of such pair of skirts is wider than the space between the top edges of said skirts, the skirts bounding each opening defining a steep funnel shape such that said opening has a somewhat larger area at the top than at the bottom thereof, the skirts in each opening being connected at the corners thereof such that said skirts form a continuous perimeter wall for such opening, and in which at least the top wall of said grate cover has a textured, skid resistant surface to facilitate walking thereon by paint spray area personnel.

13. A cover for paint spray area grates, including grates of the kind having perimeter blades bounding the perimeter of the grate, plural grate blades running in spaced parallel direction along one dimension of the grate and plural grate cross members extending transverse to the grate blades, comprising:

a lightweight, molded plastic, one piece member having:

(1) means for shielding the top of said blades and grate cross members from paint particles settling thereon, the latter means defining a top wall comprising perimeter portions integral with plural length and width cross portions bounding a plurality of openings substantially coextensive with corresponding openings in the grate to be covered, and (2) means for shielding the sides of said blades and grate cross members from sticky paint particles entrained in air drawn down through the grate, the latter means defining skirts depending into said openings from said perimeter portions and length cross portions and width cross portions, a pair of said skirts flanking each grate blade and cross member, each said pair of flanking skirts being downwardly divergent so the space between the bottom edges of such pair of skirts is wider than the space between the top edges of said skirts, the skirts bounding each opening defining a steep funnel shape such that said opening has a somewhat larger area at the top than at the bottom thereof, the skirts in each opening being connected at the corners thereof such that said skirts form a continuous perimeter wall for such opening, said skirts being about two-thirds the height of said blades and thereby terminating about one-third the blade height above the bottom of the blades.

* * * * *